US006167669B1

(12) United States Patent
Lanc

(10) Patent No.: US 6,167,669 B1
(45) Date of Patent: Jan. 2, 2001

(54) CONCRETE PLASTIC UNIT CPU

(76) Inventor: Louis Joseph Lanc, 1815 Buccaneer Ter., Sarasota, FL (US) 34231

( * ) Notice: Under 35 U.S.C. 154(b), the term of this patent shall be extended for 0 days.

(21) Appl. No.: 09/184,754

(22) Filed: Nov. 2, 1998

Related U.S. Application Data

(60) Provisional application No. 60/063,978, filed on Nov. 3, 1997.

(51) Int. Cl.[7] ..... E04B 2/18; E04B 2/20

(52) U.S. Cl. ..... 52/426; 52/429; 52/439; 52/563; 52/570; 52/588.1

(58) Field of Search ..... 52/426, 429, 439, 52/563, 568, 581, 588.1, 220.1, 275, 570

(56) References Cited

U.S. PATENT DOCUMENTS

| | | | | |
|---|---|---|---|---|
| 3,552,076 | | 1/1971 | Gregori . | |
| 4,004,385 | | 1/1977 | Kosuge . | |
| 4,167,840 | | 9/1979 | Ivany . | |
| 4,180,956 | | 1/1980 | Gross . | |
| 4,433,522 | * | 2/1984 | Yerushalmi | 2/32 |
| 4,439,967 | | 4/1984 | Dielenberg . | |
| 4,532,745 | | 8/1985 | Kinard . | |
| 4,566,238 | | 1/1986 | Janopaul . | |
| 4,706,429 | | 11/1987 | Young . | |
| 4,731,968 | | 3/1988 | Obino . | |
| 4,967,528 | | 11/1990 | Doran . | |
| 5,014,480 | | 5/1991 | Guarriello . | |
| 5,311,718 | * | 5/1994 | Tyrousilek . | |
| 5,473,850 | * | 12/1995 | Balding | 52/426 |
| 5,491,947 | * | 2/1996 | Kim | 52/426 |
| 5,608,999 | * | 3/1997 | McNamara | 52/275 |
| 5,664,328 | | 9/1997 | Melnick . | |
| 5,706,620 | * | 1/1998 | De Zen | 52/220.2 |
| 5,729,944 | | 3/1998 | De Zen . | |
| 5,740,648 | * | 4/1998 | Piccone | 52/426 |
| 5,860,262 | * | 1/1999 | Johnson | 52/426 |
| 5,869,262 | | 1/1999 | Johnson . | |
| 5,881,524 | | 3/1999 | Ellison . | |

FOREIGN PATENT DOCUMENTS 2070079 11/1993 (CA) .

* cited by examiner

*Primary Examiner*—Carl D. Friedman
*Assistant Examiner*—Yvonne M. Horton

(57) ABSTRACT

A clear, permanent form, for steel reinforced concrete structures. Sections of the clear form, are to be factory extruded, from a clear polyvinyl chloride material, so as to make the assembly of the forms, the installation of the steel and utilities, and the inspections that are required, easier. The clear forms will protect the steel reinforced concrete structures from the elements that cause these structures to fail. The clear form consists of two factory extruded profiles, that are totally different in shape. The sections that make up the form, can be modified, cut to any length or angle and assembled on site. It takes two sections, of one profile, to form both vertical sides of the form, and two sections, of the other profile, are horizontally inserted, between the vertical side sections, to create an elongated empty container. The assembled clear form is 7⅝ inches wide and 8 inches high, and is open on four sides. The assembled units are installed horizontally, and can be stacked and connected, on top of one another, to conform to any design, for residential or commercial construction.

1 Claim, 15 Drawing Sheets

CONCRETE PLASTIC UNIT CPU

CROSS REFERENCE TO RELATED APPLICATION

This application is a continuation of the Provisional Patent Application, Ser. No. 60/063,978 filed Nov. 3, 1997 and Utility Patent Application Ser. No. 09/184,754 filed Nov. 2, 1998. In response to the First Office Action Summary mailed Jul. 21, 1999. Applied for 1 month extension Nov. 20, 1999. Second response to the first Office Action in response to an Office Communication mailed May 15, 2000.

FIELD OF SEARCH

52/275, 279, 309, 421, 422, 425, 426, 427, 429, 436, 442, 581, 586, 593.

REFERENCES CITED

U.S. PATENT DOCUMENTS

| | | |
|---|---|---|
| 3,552,076 | 1/5/1971 | Werner K. H. Gregori |
| 4,004,385 | 1/25/1977 | Momotoshi Kosuge |
| 4,167,840 | 9/18/1979 | George R Ivany |
| 4,180,956 | 1/1/1980 | Fernand Gross |
| 4,433,522 | 2/28/1984 | Yaakov Yerushslml |
| 4,439,967 | 4/3/1984 | Olif F. Dielenberg |
| 4,532,745 | 8/6/1985 | George P. Kinard |
| 4,566,238 | 1/28/1986 | Peter Janopaul |
| 4,706,429 | 11/17/1987 | David Young |
| 4,731,968 | 3/22/1988 | Obino |
| 4,967,528 | 11/6/1990 | William E. Doran |
| 5,014,480 | 5/14/1991 | Theo J. Guarriello |
| 5,311,718 | 5/17/1994 | Jan P. V. Trousilek |
| 5,473,850 | 12/12/1995 | James Balding |
| 5,491,947 | 2/20/1996 | Sun Y. Kim |
| 5,664,328 | 9/9/1997 | David W. Melnick |
| 5,608,999 | 3/11/1997 | Bernard McNamara |
| 5,706,620 | 1/13/1998 | Vittorio De Zen |
| 5,729,944 | 3/24/1998 | Vittorio De Zen |
| 5,740,648 | 4/21/1998 | Francesco Plecone |
| 5,869,262 | 1/19/1999 | Frank K. Johnson |
| 5,881,524 | 3/16/1999 | Russell P. Ellison, Jr. |

FOREIGN PATENT DOCUMENTS

CANADIAN

| | | |
|---|---|---|
| 2,070,079 | 11/30/1993 | Vittorio De Zen |

BACKGROUND OF THE INVENTION (1) Field of the Invention

This invention relates to the construction of reinforced concrete and steel structures, specifically to such structures erected using CMU's (Concrete Masonry Units).

Further this invention relates to interlocking factory extruded, Permanent Forms for Concrete, that are made from Polyvinyl—Chloride (PVC), that are assembled on site (2) Description of the Related Art Cement is a mixture of a powder of alumina, silica, lime, iron oxide and magnesia burned together in a kiln and finely pulverized and used as an ingredient of mortar and concrete. Mortar and concrete is widely used in construction. Mortar is a mixture of cement, lime, sand and water. Mortar is used as a plaster, or to bond clay bricks and concrete blocks together to erect a structure. Concrete is a mixture of cement, sand, gravel, and water. The more cement, added to the mix, makes the concrete stronger.

Wet concrete is sometime poured into forms, and steel is added to give it more strength, to hold the concrete in place, until it has cured. This is referred to as, a steel reinforced concrete structure Usually these forms are made of wood, metal or combinations of each, but forms can be made from almost anything. Erecting these forms, and striping them after the concrete has set is a slow expensive process that needs to be improved on.

The problem is designing a form, that is easy to manufacture in a factory. A form, that is light weight, has very few parts, and is easy to transport to different job sites. A form, that is easy to assemble, or to modify on site. A form, that can be left in place, to become part of the structure and protects the cured concrete, after it has set, from damages caused by the elements. A form, that can be easily inspected, at any stage of erection, to make absolutely sure that all the reinforcing steel and the utilities are in place, prior to filling the form with concrete. A form, that can be inspected during the pouring of the concrete, where you can actually "see" the concrete filling the form. A form that is "clear" so that after the pour is finished, you can actually "see", the concrete inside and you can be absolutely sure there are no air pockets or voids.

There have been many attempts at designing a form, that solves some of the problems relate to construction of steel reinforced concrete structures.

The most successful, stay in place form, on the market to accomplish this is the Concrete Masonry Unit commonly referred to as a "Concrete Block". Its sizes and shapes and methods of installation are shown, in detail, in the Architectural Graphic Standards for Architects, Engineers, Decorators, Builders, Draftsmen and Students of the Construction Industry by Charles George Ramsey A.I.A and Harold Reeve Sleeper F.A.I.A.

Most Architects and Engineers prefer CMU construction, it is also preferred by the local building codes. The units themselves are inexpensive. The average concrete block plant can produce 24,000 units per day, but there are several disadvantages in using the CMU.

One is its weight. The average CMU weighs 35 lbs. The average block plant requires more than 420 tons of raw material, sand, rock, cement and water, to operate for one 24-hour period. That is about 19 truck loads, delivered to the plant, per day. The average new house, using CMU construction, contains 1,800 units, with a total weigh of 31.5 tons.

The CMU's are expensive to transport. The blocks are large and bulky, because of the hollow cell design. The block is delivered on large diesel powered trucks, that are equipped with cranes to pick up the "cubes" of a block. Each cube of block, has 72 block ea. and weighs 1.25 tons.

Each truck carries 18 cubes of block, or 1,296 units. It takes two, truck trips of block, per house. It takes one truck, to deliver the precast lintels and window sills It also requires another truck to deliver the sand, mortar mix, and re-bar, and still another truck to haul away the waste. This process is not only expensive, but it has a grave impact, on the quality of the air, that we breathe.

Some of the Prior Arts address this problem. The high cost of shipping, by offering a light weight form, but they fail to point out the impact of so many truck trips has on the environment.

The labor cost for laying CMU's is expensive. The blocks have to be laid one at a time in a brick like fashion, so that the hollow cells line up vertical to form wells, so that the steel can be installed and the concrete can be poured into the wells. The blocks have to be carefully laid to a string line and each has to be plumb and level. Each unit has to be set in a bed of mortar. Mortar has a tendency to shrink slightly and may pull away from the masonry units causing fine, almost invisible cracks at the junction of mortar and masonry units. These cracks allow moisture to enter the wall cavities.

This is one, of the hardest skills to master, in the construction industry. It takes experienced professionals and they are paid accordingly.

Some of the Prior Arts address this problem by offering a form that is easy to assemble on site by unskilled laborers.

Local conditions frequently demand special construction methods that require additional strength by reinforcing the walls with reinforcing rods encased in the poured concrete. The walls may require horizontal reinforcing rods, this requires a special block called a "lintel block" with knock-outs on the ends and in the center. Local building codes may require forming a bond beam, at each story height. This usually requires another sub-contractor skilled in structural concrete forming.

The forming material, usually precut ¾" plywood, "H-clamps," or "snap-ties and pig's feet" have to be delivered to the job site and erected. After the bond beams are poured with concrete, the wood forms have to be stripped, cleaned and shipped or stored until the next job.

Some of the Prior Arts address this problem by offering a "form" that stays in place to reduce the cost of wrecking, and cleaning reusable forms.

Where vertical reinforcement is required in CMU construction, it is usually located at building comers, jambs of wall openings and at regular intervals between wall openings. In placing the vertical reinforcement, advantage is taken of the vertical alignment of the hollow block cores which form wells, into which the reinforcing bars are placed and filled solid with concrete. If the wells are not rodded clean, of the extruded mortar and the debris removed prior to pouring, the concrete fails to fill the well solid with concrete. This mistake is usually not discovered, until after a disaster happens, such as earthquakes and hurricanes, because the units are made of a solid material, and you cannot "see" inside of the blocks to "see" if the cells were filled with concrete and steel.

None of the Prior Arts, has addressed this problem, until now. This Applicant offers a "Clear Form" extruded, from a clear resin of polyvinyl chloride for Reinforced Concrete Structures. to aid the Inspectors, so that they can make thorough complete inspections.

The end results of a structure built using Concrete Masonry Units, is a steel reinforced column and beam structure with hollow CMU's between the columns, that is exposed to the elements. When water penetrates the concrete the steel will rust. When the steel starts to rusts it swells and then the concrete will crack.

Some of the Prior Arts address this problem, by offering a thermoplastic form, with the ability to provide a monolithic concrete pour, but most fail to point out the added feature that that is achieved by protecting the cured concrete, from the elements that cause these structures to fail.

There are many more problems related to concrete construction, with concrete blocks and with styro foam molding blocks.

Such as the high cost of pre-cast lintels that have to be installed over any opening it some time takes two or more men to lift them into place. Some time heavy equipment is required.

The rough surface of the interior face of the CMU requires it to be covered with drywall. This is accomplished by securing wood furring strips to the CMU's with "T-nails or screws and attaching the drywall to the furring strips.

This process usually requires several days to finish. The exterior face of the CPU's has to be covered also. There are a variety of exterior finishes.

Exterior stucco is the most widely used. It is generally composed of a Portland cement base. It requires a "scratch coat" of Portland cement stucco, a "brown coat" of Portland cement stucco and a "finish coat" of Portland cement with any desired finish, smooth, rough etc. The stucco process usually takes several days.

Some of the Prior Arts address this problem, but not to the extent as to eliminate the pre-cast lintels and the drywall and furring strips as this applicant's invention does, to further reduce the cost of construction.

As you can see there is, a great need, to find a better way to build structures and a better way to inspect them, for residential and commercial use. After a disaster such as hurricanes, and floods as we have just seen with hurricane Floyd, the structures, are usually rebuilt using the same methods of constructions, that was used in the original construction and it will leave the new structures as vulnerable to disasters as the old ones. It was reported on TV that some of these homes have been repaired several times at cost that exceed the value of the property. In most cases, the new structures, rather built with CMU's or wood frame will use drywall on the interior of the structure. Even if the structure is not damaged by the wind, the rising waters, ruin the drywall. Usually all of the drywall, has to be replaced, if it is subject to flooding, even if only by inches. The drywall acts like a sponge and soaks the water up the wall. The intruding water then remains trapped behind the drywall damaging or rotting water sensitive elements, until it is torn out and replaced.

There have been hundred's of patents filed, to correct these problems, with CMU construction, and to reduce the expense involved in erecting, steel reinforced concrete structures. There have been many proposals and inventions, that advocate the use of Plastic, in the building construction field, to solve the high cost of construction and to solve the water intrusion problem, that causes these structures to fail.

Some of the proposals offer plastic panels, total plastic houses, to include all components required to assemble a house. Plastic hollow boxes and systems that use expanded polystyrene (EPS) Most efforts have been directed toward the concept of pouring a complete monolithic wall system, using some type of form, to hold the wet concrete in place, until the concrete has cured, leaving the form to stay in place and become part of the structure.

Some of these patents, solve some of the problems, related to steel reinforced concrete structures and those built with concrete masonry units and solid styro foam building blocks. They use a variety of different materials and combinations of different materials to make their forms.

Because of the inherent characteristics of buildings in general and specifically to walls, all of the Prior Art forms, are usually a plurality of substantially Identical, Elongated, Parallel Facing, Surfaces, consisting of two to four panels or more, having internal web walls spanning between said surfaces, that have holes in them, so that the liquid concrete will flow freely, through the wall cavity system. The forms, mentioned above, all interlock and interconnect in some way by sliding, slipping, or stacking, using various types of male and female slots, notches, flanges or "tongue and groove joints" that receive matching "Tees", "Ells", "J Hooks", "I" beams, "U" shaped brackets, "dove tails", and "pin and holes", that when assembled at the factory or in situ, provide a shell, sheath, cavity, louver, shuttering, or a container, or some other "term", "invented", by those Skilled in the Art of Legalese, such as an "open mouth", (referenced in U.S. Pat. No. 5,608,999 issued to McNamara column 7 line 15) to describe the same thing.

These combination of different parts, materials, and different terms still perform only one function, the Object, to hold the wet concrete and steel in place, until it has cured.

None of these patents address the main problems of why, steel reinforced concrete structures fail. The suggestions usually offer a cheaper, faster, easier method using unskilled labor to erect structures in undeveloped countries.

No one addresses the problems that cost Lives.

The main problem with the failures, to Concrete Structures, that collapse during disasters or just simply corrode is "Improper Building Inspections".

Reinforced Concrete Structural Forms, require both horizontal and vertical steel to be installed according to Code, before any Concrete can be poured.

Local Building Departments, in each State, are required to make inspections of these forms, prior to pouring any concrete.

These inspections, are very difficult to make. Usually the walls are 8 feet or higher. Some walls require rake beams, that sometime reach heights of 22 feet or more, depending on the design.

In order for the inspector to do his job right, it may require several hours to make a thorough inspection.

It is almost impossible, to thoroughly inspect, a reinforced concrete structure. Because of the amount of inspections, the Inspector is required to make, on any given day.

These Inspectors, are under tremendous pressure, from the Builders and from the Public, because Lives and Money are at stake.

If a structure fails, the Building Dept. is held responsible, and the Inspector could loose his job.

If a structure is poured with concrete and it is discovered that some of the steel was missing, prior to pouring. The construction site, is shut down, until corrections are made.

Lives could be lost.

This requires hiring a Engineering Company, at a great expense, that specializes in making inspections after concrete is poured, to come in and make X-Rays or Magnetic inspections, of the concrete walls, to find out how much steel is missing.

Walls may have to be torn down, some masonry walls may have to be cut from ceiling to floor, where the steel is missing, and new steel has to be added, plywood has to be installed to cover the holes, to contain the concrete and the cells re-poured with new concrete. Some of the hollow cells of the concrete block, may have steel in them, but sometime some of the sub-contractors may place "cavity caps" over the cells to prevent the concrete from flowing down through the hollow cells, or maybe it was just an accidential blockage.

These repairs might take months to complete, but "no one will ever know", if all of the repair work was done right. It will take a another disaster to discover the truth.

As you can see there is a "special need" to be able to inspect, the assembled forms, at any stage of erection prior to pouring the concrete. A need to be able to "watch" the liquid concrete fill the forms. There is also a need to protect the cured concrete from the elements mainly moisture, that cause the steel to rust, that causes the concrete to crack and the cracks that allow more moisture to penetrate the concrete and in turn cause the structures to fail.

This Invention, solves both of these problems , the inability to be able to "see" inside of the concrete forms, by using a clear form, and in the process, the form also covers the cured concrete, with a coating of ⅛ inch of clear plastic, to protect the concrete from the elements.

This clear form is clearly an improvement over the prior Arts, pertaining to Concrete Forms and Concrete Masonry Units and solid poly foam building blocks, by producing several new and unexpected results that helps make Inspections easier and in the process protects the cured concrete.

"Imagine how easy it would be to Inspect the installation of the steel and the utilities if they were inside clear forms."

The Men, installing the Clear Forms, could "look back" and be certain that they had installed every thing, according to the plans and specification, if mistakes were made, they could correct any problems.

The General Contractor or the Owner could also "see", that every thing was in its proper place, before calling for an Inspection. There is a tremendous loss in time and money due to delays when a job site fails an inspection. Most Building Department, usually charge a fee for having to make an extra trip to complete the inspection.

The Inspector, could make his inspection, with out the dangers of using ladders, to climb up on, or having to use mirrors, attached to the end of poles, that the inspectors have to use sometime, to be able "see", down inside of the forms, to see that the reinforcing steel was installed right the Inspectors would then have the Satisfaction of Knowing, that when they sign the building permit, as proof that they made a proper inspection because they could see, every thing was in its proper place.

Even after the concrete is poured, you could still see that all of the hollow cells were filled solid, with concrete without voids. Because you will be able to "see" the concrete, inside of the Clear forms.

This is an Major Improvement over all of the prior arts.

BRIEF SUMMARY OF THE INVENTION

There are several Objects, of the present invention, a Concrete Plastic Unit.

(1) One object, of the present invention, is intended to be an improvement over the other concrete forms, in general, that have been referenced, and specifically the Concrete Masonry Unit and that is to provide a form, to contain wet concrete and steel, in place until it has cured.

(2) Another object, is to extrude the sections, that make up the form, from a "Clear" Poly Vinyl Chloride Plastic Material. The reason for using a "Clear" PVC Material, is to correct some the problems associated with the failures of steel reinforced structures.

The main problem, is the inability to inspect the placement of the steel, or to be able to watch the liquid concrete fill the form. This problem, is what causes the most failures, but are not usually discovered until after a disaster happens, because of voids in the concrete, caused by air pockets or blockage or simply because reinforcing steel was left out. None of the referenced prior arts, addressed this problem.

(3) Another object, is to reduce the cost of manufacturing the forms. This is accomplished by using, very few parts. This invention uses only two shapes. To those, Skilled in the Art of Manufacturing Extruded Parts, this shape, is called a Profile. This Profile, is the outline, that is milled or cut into the die, that is used to extrude the clear plastic shape. These dies are very expensive. The more shapes you have to use, to create a form, the more dies, you have to have.

By using only two Profiles, you reduce the number of Dies and Sizors, necessary to produce the forms, thereby reducing the overall cost.

Another reduction in cost, is accomplished by using a clear PVC resin, so that color does not have to be added, and the equipment does not have to be "purged", when changing the extrusion Dies. This "purging" is needed if you use different colors, which sometimes take a long time and results in a lot of waste. There is very little "waste" in the manufacturing of the forms if you use only Clear PVC Resin.

Also this type of PVC resin does not have the abrasive characteristics as described in some of the referenced patents, thereby reducing the wear and tear on the dies, so they last longer. Another reduction in cost, is the process of punching Large Holes into the center sections, of Profile 2. Also by using a Clear Resin these "cut outs" can be put back into the hoppers that feed the extrusions with out wasting anything.

Another savings, that is never mentioned, is the ability to use a "virgin resin, only one time". The resin used to make these forms will never end up in a dump, or someplace else, that will result in having to recycle the plastic, used to make these forms.

(4) Another object, is to reduce the cost of shipping the finished product. The "unassembled units", stack flat. Four sections, two sections of Profile 1, and two sections of Profile 2 are needed to assemble a Concrete Plastic Unit. The four sections are stacked together and banded together as one unit without extra packaging. This unit when stacked flat in an unassembled state is only 1 inch high. This unit can be cut to any length.

It is suggested that the units be shipped in 16 feet to 20 feet lengths for easy handling. A 16 foot long unassembled unit weighs only 32 lbs.

This is about the same weight, of one single, "Concrete Block". When one 16 foot section of an assembled Concrete Plastic Unit is anchored into place horizontally, it is the same as "laying" 12 concrete masonry units.

This reduction in weight also reduces the amount of truck trips it takes to manufacture and deliver the finished product to the job site. Compared to manufacturing the concrete masonry units, the block plant requires 420 tons or 19 truck loads of raw material, sand, rock cement and water to operate a one 24 hour period. This is roughly 31,920 lin. ft. of concrete masonry units.

Only two truck loads of clear PVC resin and additives, will produce 38,000 lin. ft of Concrete Plastic units in the same amount of time.

This reduction in truck trips would improve the quality of air that we breath. This impact on the environment was not mentioned in any of the referenced Prior Arts.

(5) Another object, is to provide a clear form for concrete, that is light weight, and easy to assemble on site. This form, can be assembled using only two shapes to form a hollow elongated container/shell, that can be filled with wet concrete and steel, that is open on "four sides". The two shapes are totally different from each other and cannot be mixed up. It only takes two sections of Profile 1, and two sections of Profile 2, to assemble a Concrete Plastic Unit. To keep from being redundant, I will detail this assembly later, in the description of the invention.

(6) Another object, is to provide a clear permanent concrete form, that is installed horizontally, to solve the problem, of installing horizontal steel. By placing the forms on a horizontal plane it is possible to install reinforcing steel, in any course, so that the steel is bent around the comers. This "bend" is required by local building codes, or according to the techniques used by Architects and Engineers. The problem, of installing vertical steel, is solved, by the use of the large holes that are punched in a pattern, into Profile 2, in the center sections, of the forms. Another advantage of installing the units horizontally is the ability to be able to cut the units both horizontally and vertically, on site.

(7) Another object of the present invention is to provide a method to secure the first horizontal course to the slab or footer. This is accomplished by use of a special plastic anchor, that locks into the base of Profile 1, to anchor the unit to the concrete slab and to keep the form, from spreading.

(8) Another object of the present invention is to provide a means to stack the Concrete Plastic Units on top of one another to form any shape or type of structure, into which the reinforcing steel can be installed and the wet concrete can be poured into.

This is accomplished by sliding the base of a section of Profile 1, into an offset flange, located on the top ¾" outside face of another section of Profile 1, in a top to bottom, relationship.

The unique configuration of Profile 1 serves four purposes:

A: A means to connect the CPU's together, horizontally.

B: A means to provide a flush smooth joint or seam at the connection.

C: A means to provide the continuous lateral tensile strength needed to contain the wet concrete until it has set.

D: A means to connect two sections of Profile 2, horizontally to spread the unit exactly 7⅝" wide. I will detail this later, in the description of the invention.

(9) Another object, is to provide the form, with additional strength in the middle of the CPU keep it from "bowing out" when wet concrete it introduced into the form. This is accomplished by providing, a continuous horizontal reinforcing spacer and slot, to receive one side rail of Profile 2 on the inside, middle of Profile 1, exactly 4½ inch on center, up from the base of profile 1.

This spacer, serve two purposes.

One, the additional strength. When Profile 1 and Profile 2 are connected together, at this point, this reinforcing spacer is ½ inch thick. Doubles the strength at this point.

The second purpose, is to provide another offset, so that profile 2, can act as an insert/spreader that can be used in both locations, without having to use another profile of a different width.

(10) Another object of the present invention, is to provide a clear plastic form for concrete, that can be modified on the job site using conventional tools and semi-skilled labor. so that the sections can be cut, to fit any design, by an Architect, and to be able to cut the sections, to form any angle

(11) Another object, of the present invention, is to eliminate all precast lintels over windows, doors and large openings, and to eliminate, wood formed, steel reinforced bond beams.

(12) It is also another object of the invention to eliminate all the furring strips and the drywall on the interior walls of a commercial or residential building.

Further the present invention is designed to eliminate an extra sub-contractor to erect all the interior walls. By using a different width of Profile 2. Profile 2 can be designed to make any width of wall, that is specified, but this would require another die to do this.

(13) Still another object of the present invention is to provide a clear plastic form that will stay in place to protect the cured concrete and steel from the elements that causes such structures to fail.

This is accomplished by covering the concrete with ⅛ inch costing of clear plastic.

There are several advantages to using the related invention, the Concrete Plastic Units.

One advantage is Water Management. The water problem does not exist, when the concrete is totally sealed in clear PVC.

The reinforcing steel will not be exposed to the elements that cause the steel to rust, which in turn causes the concrete to crack.

Another advantage is the CPU's have an anchor system, that secures the first course to the slab to aid in the assembly of the walls.

Reinforced concrete structures built with CPU's are the same size as those built with Concrete Masonry Units. All doors and windows that are designed for CMU construction will work with the CPU constructions.

Another advantage of using a transparent PVC is because it provides a high impact resistant product, that is not easily damaged. The design of the profiles are such, that if an edge is damaged, just cut off the damaged part. There is hardly any waste, because the design uses only two extruded profiles.

Another advantage in using the present invention is to reduce the number of the back problems, and accidents associated with CMU construction, and maybe prolong the productive life, of the men Skilled in the Art.

The above summery of the invention will become better understood with a descriptions of the drawings and a detailed description of the invention.

| REFERENCE NUMERALS IN DRAWING | |
|---|---|
| 10 | Profile 1 |
| 12 | Square Edge |
| 13 | Smooth Seam or Joint |
| 14 | Continuous ⅝ inch Rail slot 1A |
| 16 | Continuous ⅛ inch Rail Slot 2B |
| 18 | ⅝ inch Base |
| 20 | Profile 2 |
| 22 | 7⅛" Punched Hole |
| 24 | 4⅛" Punched Hole |
| 26 | Continuous Side Rail |
| 28 | Continuous Reinforcing Spacer |
| 29 | Insert/Spreader Lock |
| 30 | 7⅜" Anchor |
| 31 | 7⅝" Corner Insert |
| 32 | 7⅝" "T" Insert |
| 33 | 4½" "T" Insert |
| 34 | Monolithic concrete footer and slab |
| 35 | Horizontal #5 Reinforcing Bar |
| 36 | Up Terns #5 Reinforcing Bar |
| 37 | Vertical #5 Reinforcing Bar |
| 38 | Tapcon Concrete Screws |
| 49 | Horizontal Cut in a Concrete Plastic Unit |
| 50 | An Assembled Concrete Plastic Unit |
| 54 | ⅞ inch Stucco Finish |
| 55 | Cementitious Synthetic Plastic Finish |
| 55A | Thickened Plaster Finish |
| 56 | Pre Cast Concrete Window Sill |
| 57 | Marble Window Sill |

-continued

| REFERENCE NUMERALS IN DRAWING | |
|---|---|
| 58 | Standard Aluminum Window |
| 60 | Poured Concrete |
| 61 | 2" × 2" Aluminum 90% angle |

BRIEF DESCRIPTION OF THE DRAWINGS

The accompanying drawings will show the advantages of the present invention, the CPU. They will show how the two extruded Profiles combine to create a Clear Plastic Form, that should reduce most of the problems associated with CMU Construction, Reinforced Concrete Structures and Solid Poly Foam Building Blocks.

The unique shape of the offset flange, allows three sections to be joined together, two sections of Profile 1, 10, are connected in a bottom to top relationship, and one section of Profile 2, 20, is joined horizontally, to create a continuous strengthen Smooth Seam or joint 13, ¾ inches thick. Doubling the strength of the form at this point.

Figure 4:
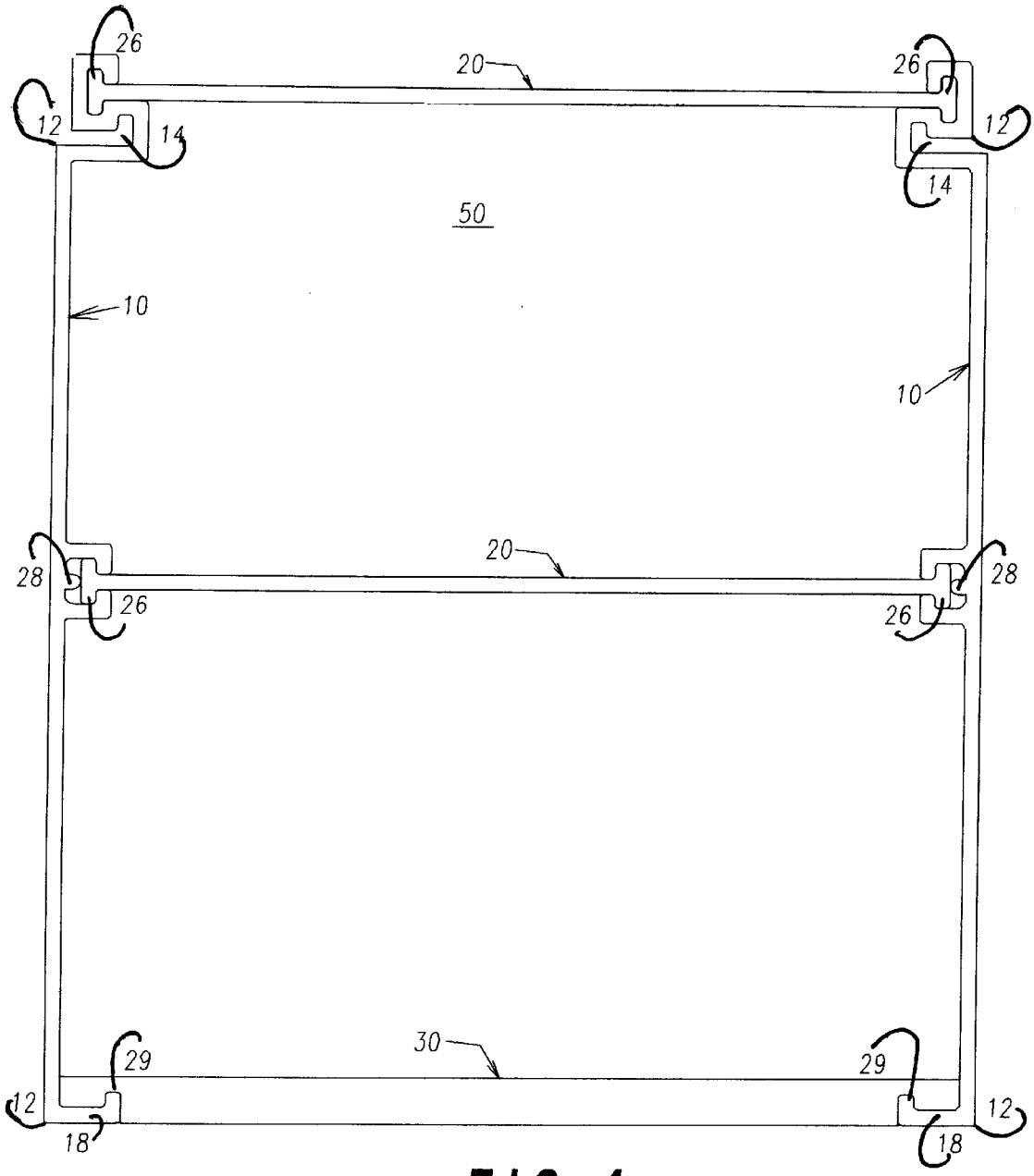
FIG. 4, is an end view of the Assembled CPU, 50. This view details how the four sections fit together and how the 7⅜" Anchor, 30 with the Insert/Spreader lock, 29, attaches over the ⅝" base, 18 with the perpendicular ⅛" bend to attach the unit to the concrete slab. It also details how the Continuous Reinforcing Spacer, 28, is used to strengthen the side walls and acts as a spacer, to allow the same Profile 2, 20, to be installed at the top and in the middle of the CPU, 50. The, Continuous Side Rails, 26, slide into matching Continuous ⅛ inch Rail Slots 2B, 16, inside of the form. This detail shows the empty ⅝" Rail Slot 1A, 14, in the offset flange, and the Square Edges, 12.
Figure 4A:
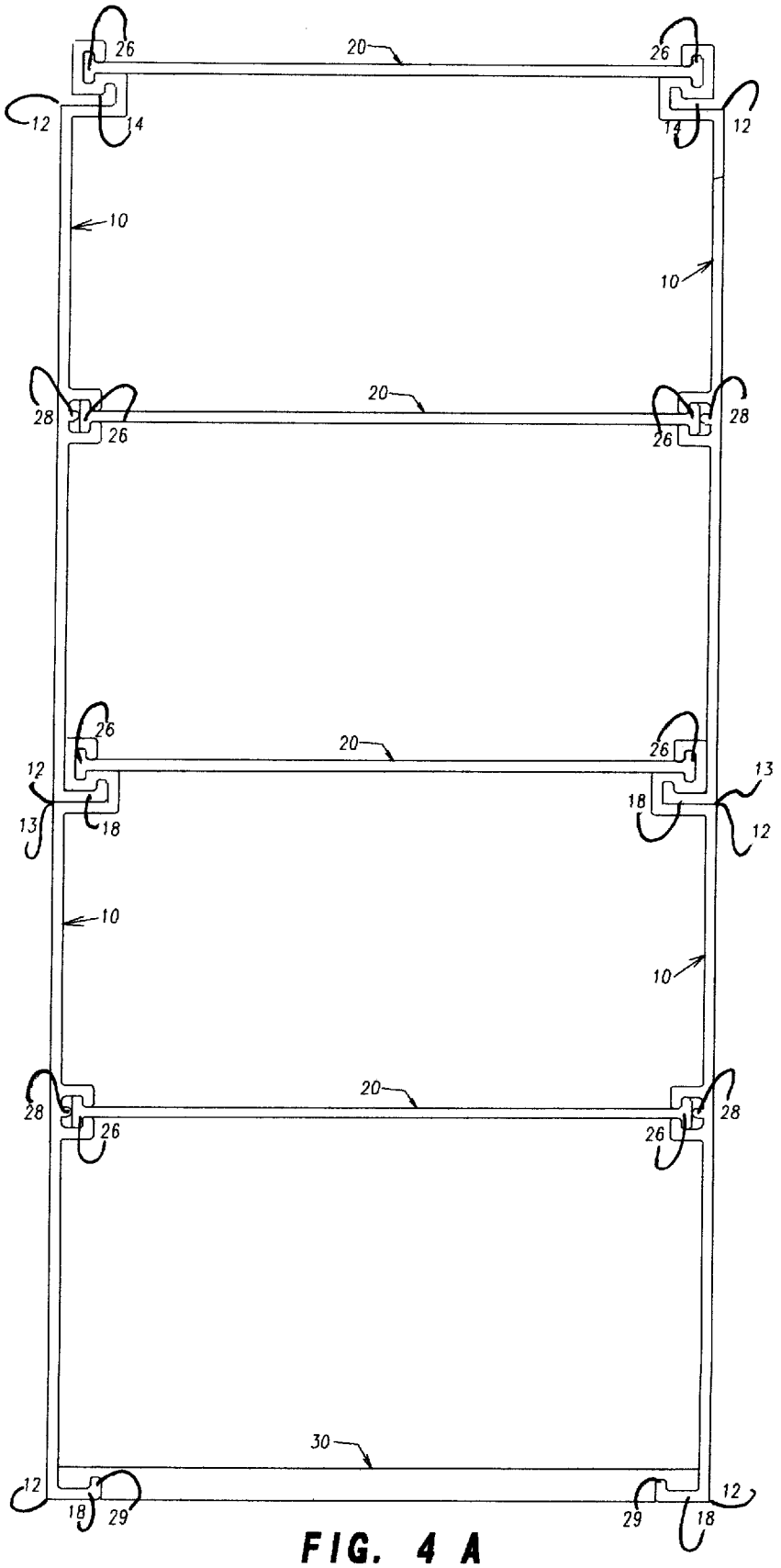
FIG. 4A, is an end view, showing how two assembled CPU's, 50 are joined together to create an almost invisible Smooth Seam or joint 13.
Figure 4B:
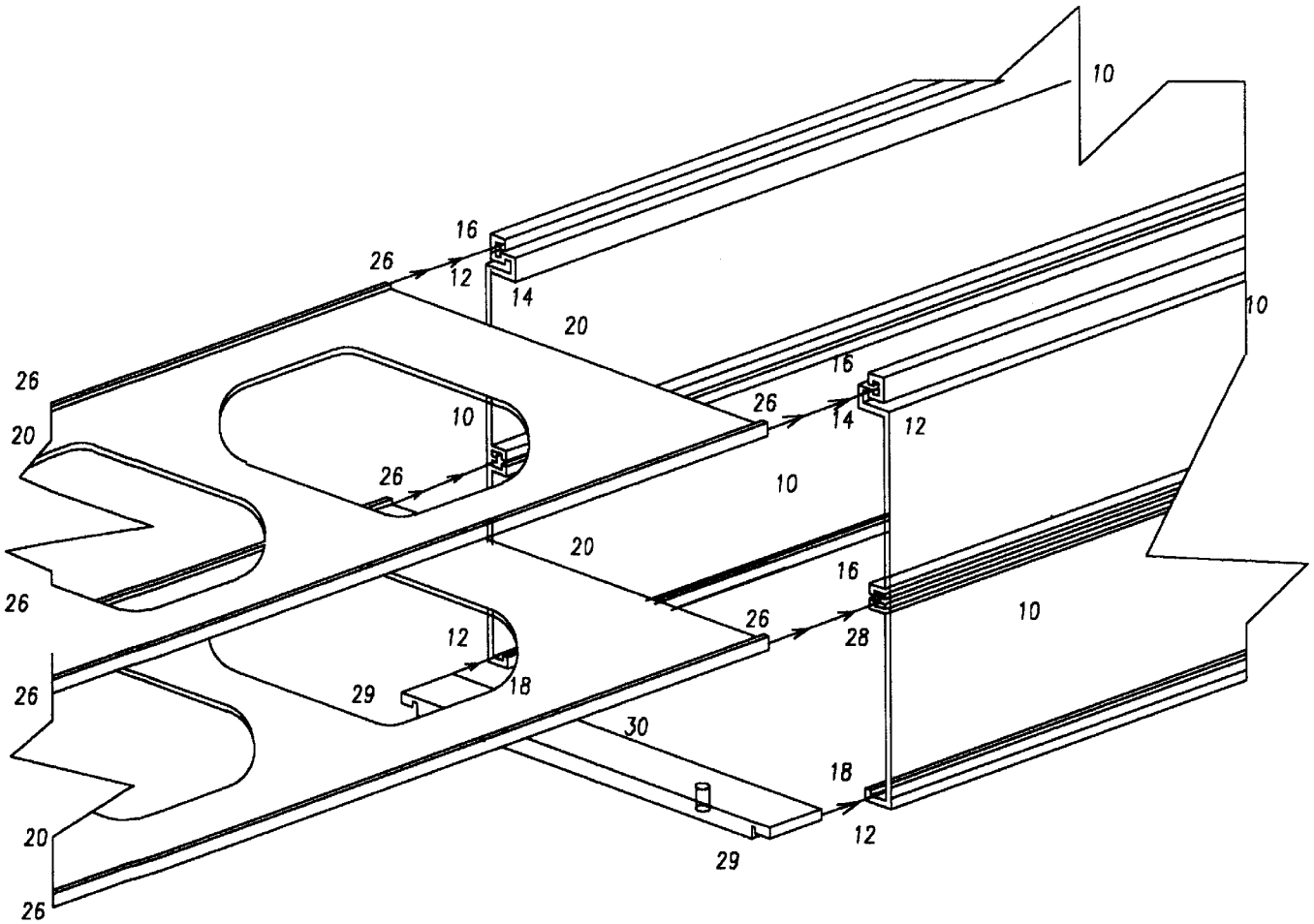

FIG. 4B is an exploded view, showing how the Profiles 1, 10 and Profiles 2, 20, are intended to be connected, to assembled a Concrete Plastic Unit, 50. This detail also shows the 7⅜" Anchor, 30, and the Insert/Spreader Lock, 29, that fits over the ⅝ inch Base, 18. This detail shows how the Continuous Side Rails, 26, of Profile 2, 20, will slide into the Continuous ⅛" Rail Slots 2B, 16, in the offset flange and at the Continuous Reinforcing Spacer, 28. It also shows the Square Edges, 12. This detail also shows the empty continuous ⅝ inch rail slot 1A. 14. This drawing attempts to show the transparency of the forms.

Figure 4C:
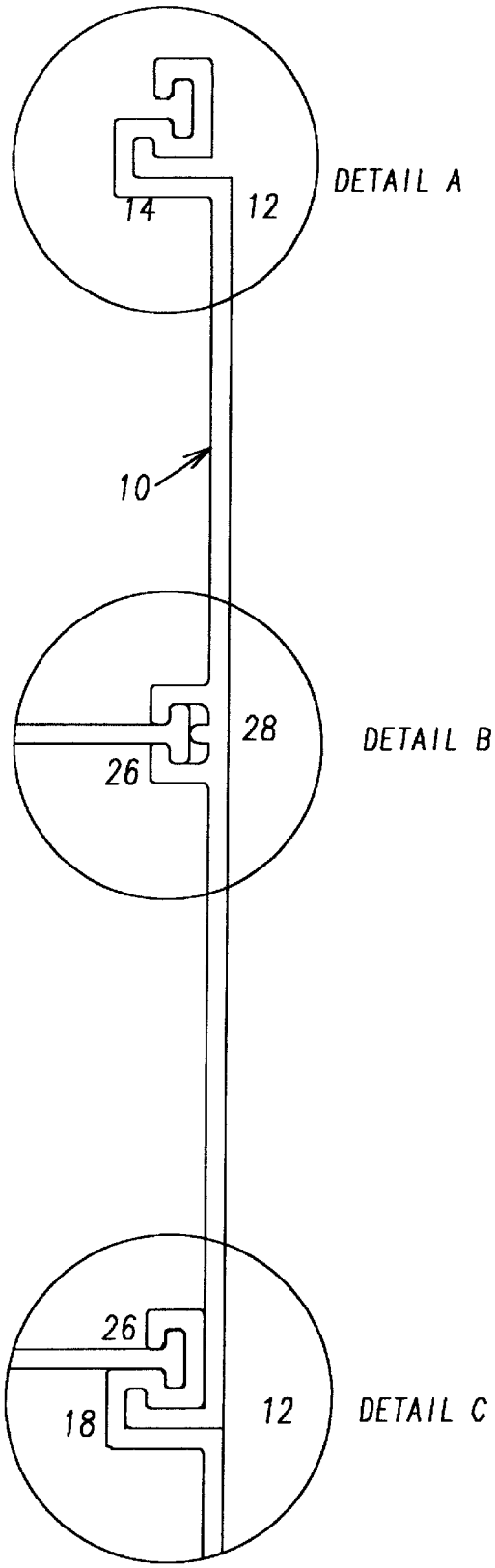

FIG. 4C is a close up view of the unique shape, of Profile 1, 10, with three details.

Detail A, shows the offset flange with the Continuous ⅛ Inch Rail Slot, 2B, 16, empty. This detail also shows the empty Continuous ⅝" Rail Slot 1A, 14, empty, with the Continuous Square Edge 12.

Detail B, shows the Continuous Reinforcing Spacer, 28, with one side of the Perpendicular, Continuous Side Rail, 26, of Profile 2, 20, inserted in the Continuous ⅛ Inch Rail Slot 2B, 16.

When the two sections are connected together, the Continuous Reinforcing Spacer, 28, and a Continuous Side Rail, 26, make this connection ½ inches thick, at this point. Doubling the strength of the form at this point Detail C, shows how two sections of Profile 1, 10, are joined in a bottom to top relationship by sliding the ⅝ Base, 18, of one section of Profile 1, 10, into the Continuous ⅝ inch Slot 1A, 14, located at the top offset flange of another section of Profile 1, 10. This connection combines the two Square Edges 12, together to form an almost invisible Smooth Seam or Joint, 13. With the Continuous Side Rail 26, inserted into the Continuous ⅛ inch Rail Slot 2B, 14, this forms a Continuous Strengthening Smooth Seam or Joint, 13 ¾ inches thick at this point. Doubling the strength of the form at this point.

Figure 5:
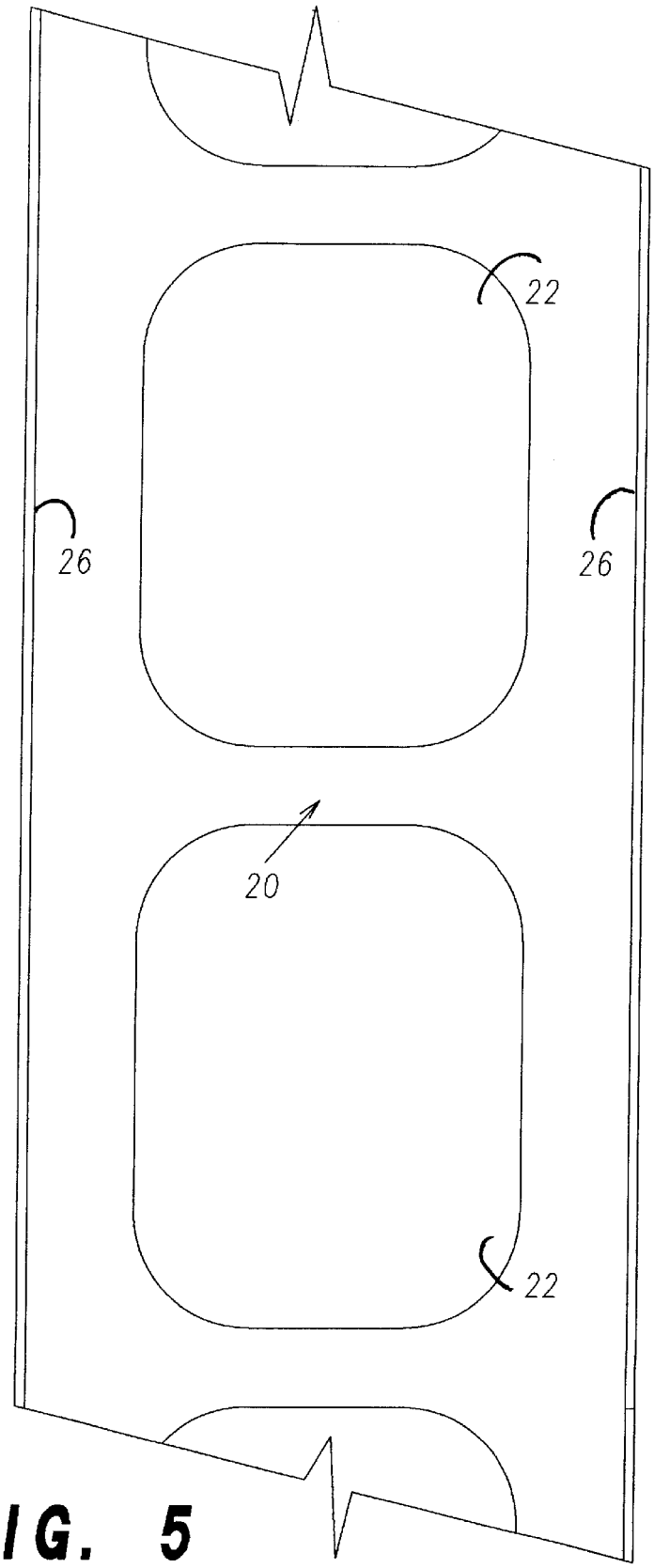

FIG. 5, is a top view of profile 2, 20, this view details the shape of the 7⅛" punched holes 22 and the continuous stamped pattern. This view also details the perpendicular Continuous Side Rails 26, on each side of the 7⅛" punched holes, 22.

Figure 6:
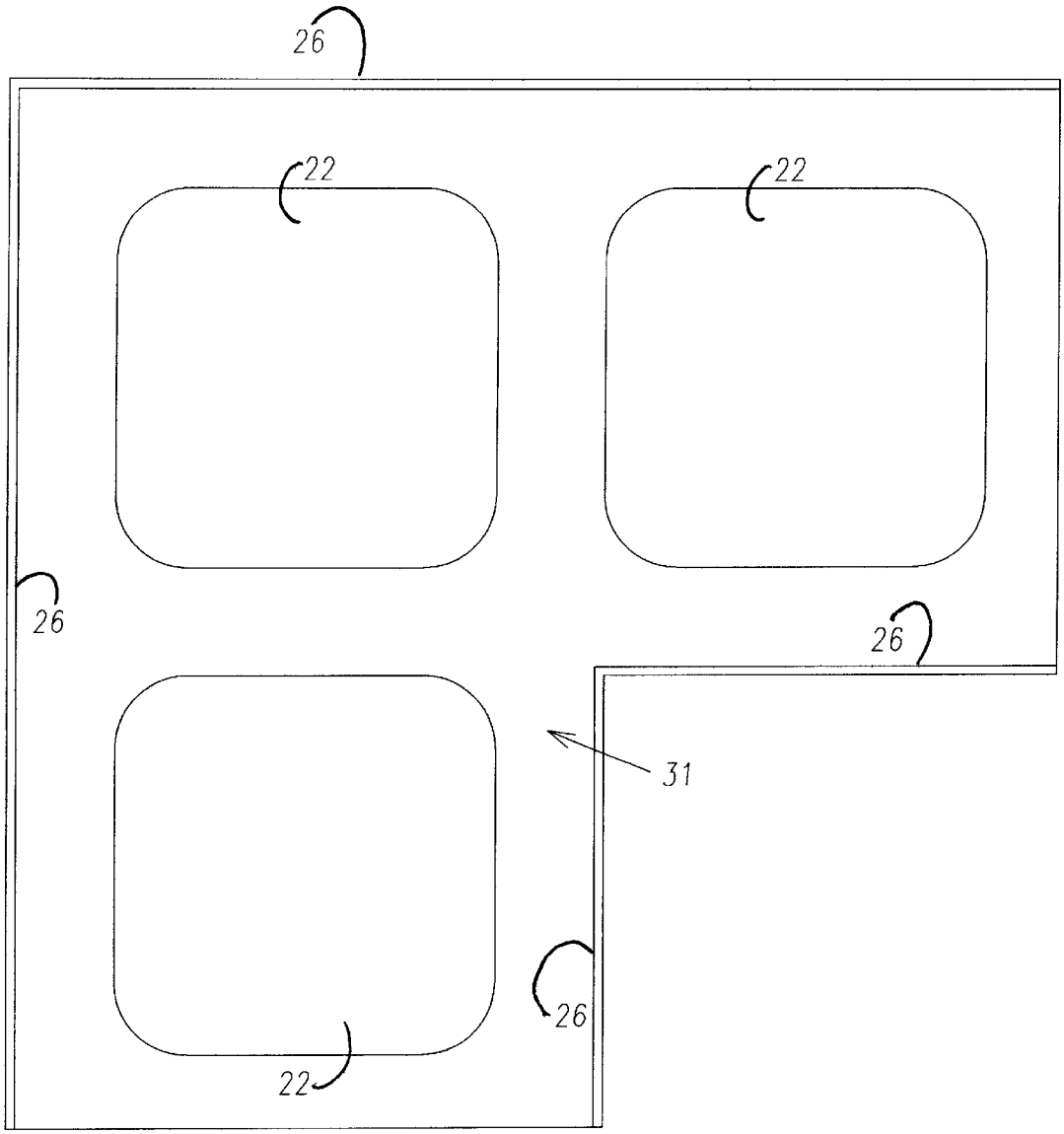

FIG. 6, is a top view of the vacuum formed 7⅝" Corner Insert 31. This view details the shape of the 7⅛" holes 22, and the Continuous Side Rails, 26. The 7⅝" Corner Inserts, 31 are used to make a 90% corner. This is an option and is not needed to complete a structure.

Figure 7:
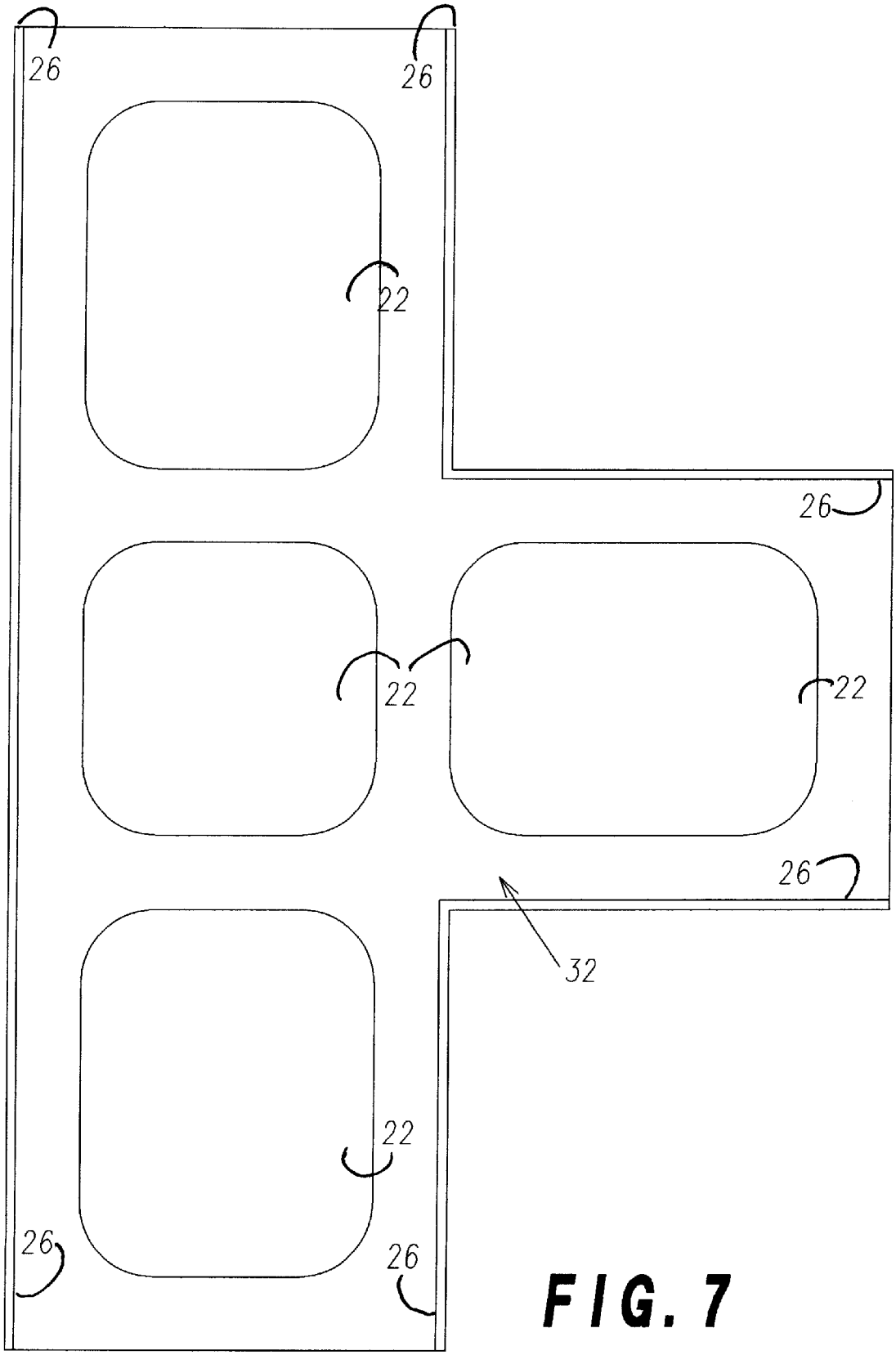

FIG. 7, is a top view of the vacuum formed 7⅝" "T" Insert 32. It details the 7⅛" Punched Holes, 22 and the Continuous Side Rails, 26. The 7⅝" "T" insert, 32 is used whenever a wall intersects with a wall, of the same width. This is also an option and is not needed to complete a structure.

Figure 8:
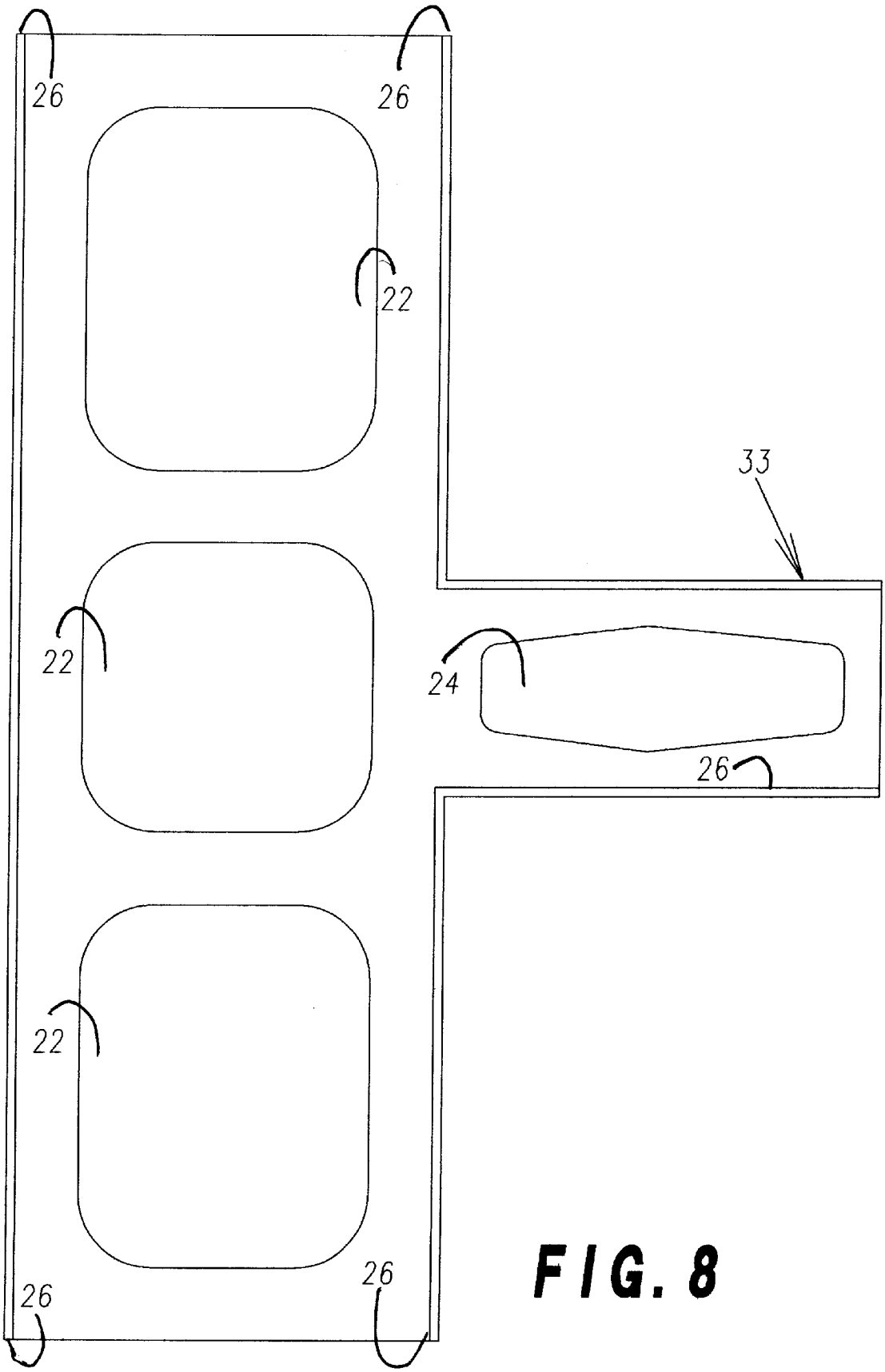

FIG. 8 is a top view of the vacuum formed 4½" "T" Inserts 33. It details the 7⅛ Punched Holes 22 and the 4½" punched holes 24. This 4½" Insert, 33 is used whenever an exterior wall intersects with a 4½" partition wall, that has been chosen to be replaced with a reinforced concrete wall, instead of a wood framed wall. The perpendicular, Continuous Side Rails, 26 are the same size, only the width is changed. This too is an option and is not needed to complete a structure.

Figure 9:
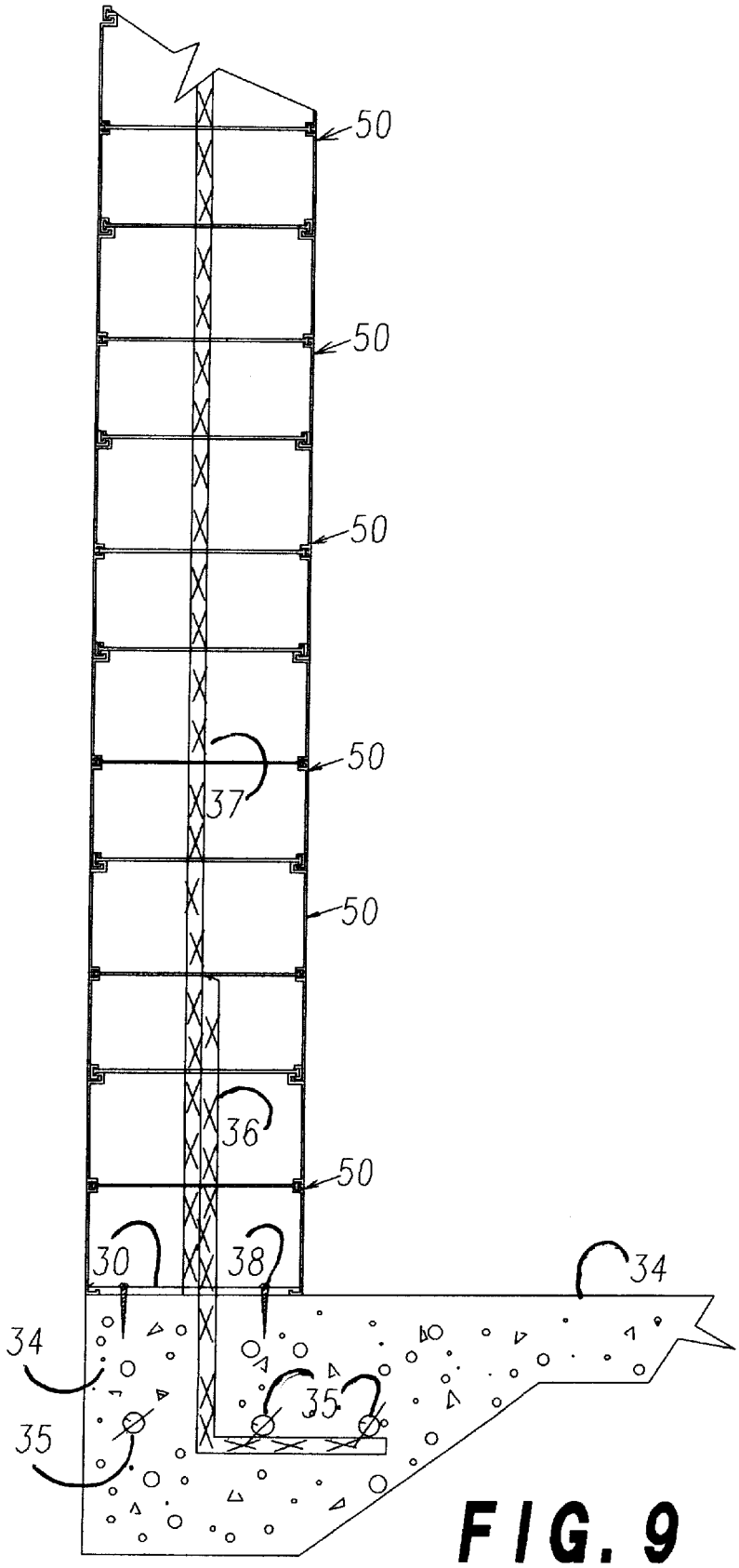

FIG. 9 is a detailed, typical w all section, using CPU's, 50 instead of CMU's. It details a cross section of a typical Monolithic Concrete Footer and Slab 34. The footer is reinforced with three horizontal #5 Reinforcing Bars, 35, to carry the weight of a solid concrete steel reinforced structure. This view details the #5 Reinforcing Bar Upturns 36 and the Vertical #5 Reinforcing Bars 37 inside the CPU's,. 50. This detail shows how the first course is attached to the Monolithic Concrete Footer and Slab, 34, with the 7⅜" Anchor, 30, and two tapcon screws, 38.This detail also shows how the assembled CPU's, 50, are stacked on top of each other, to form a wall. The forms are shown empty except for the steel.

Figure 10:
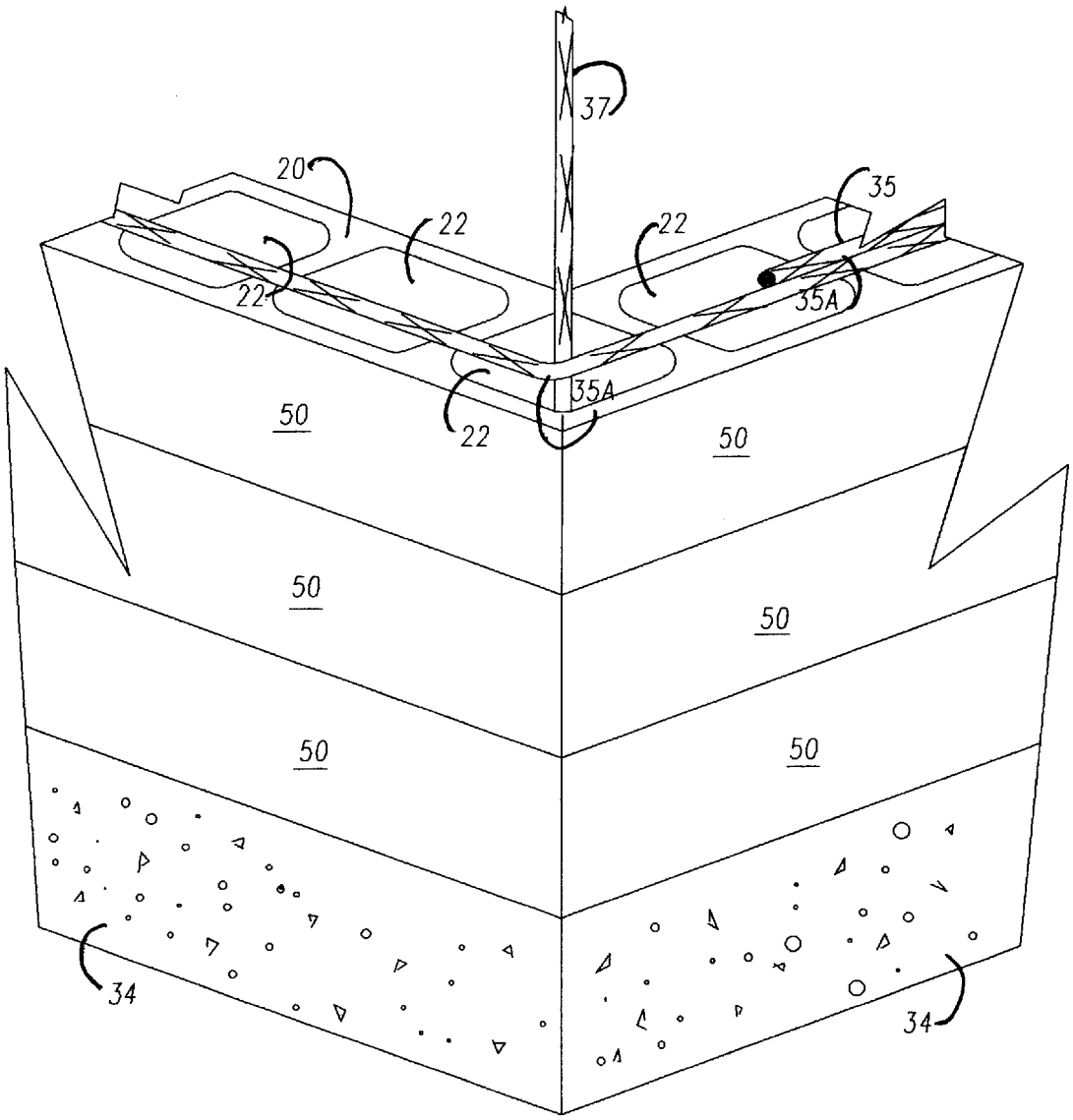

FIG. 10 is a perspective view detailing how the 90% corner 7⅝" Inserts 31, help form the corner of a structure using CPU's, 50 . It details the Monolithic Footer and Slab, 34 supporting the assembled CPU, 50 formed wall with the vertical #5 Reinforcing Bar, 37, protruding through 7⅛" Punched Holes, 22. This detail, also shows how a Horizontal #5 Reinforcing Bar, 35, is Bent around a corner and Lapped, 35A, This Detail is required by most building codes. The forms, are empty in this drawing. Transparency of the forms are not detailed.

Figure 11:
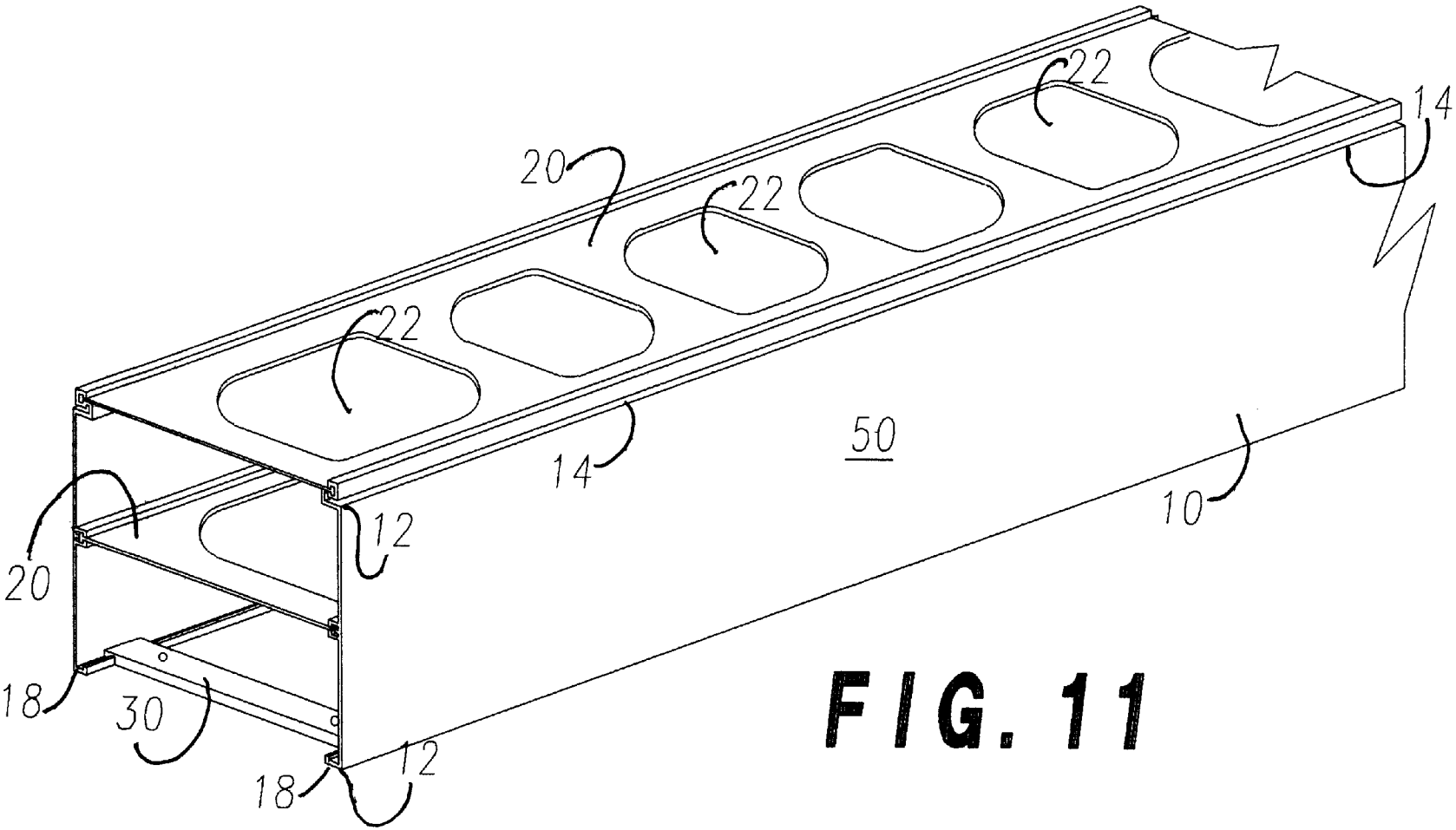

FIG. 11 is a perspective view of an Assembled CPU 50. The form is open on four sides. This detail shows the 7⅜" Anchor, 30, in place over the ⅝ inch Base, 18. The Profiles 1, 10, are shown vertical, on both sides, with the two Profiles 2, 20, installed horizontally inside of Profile 1, 10. Transparency is not detailed in this drawing.

Figure 12:
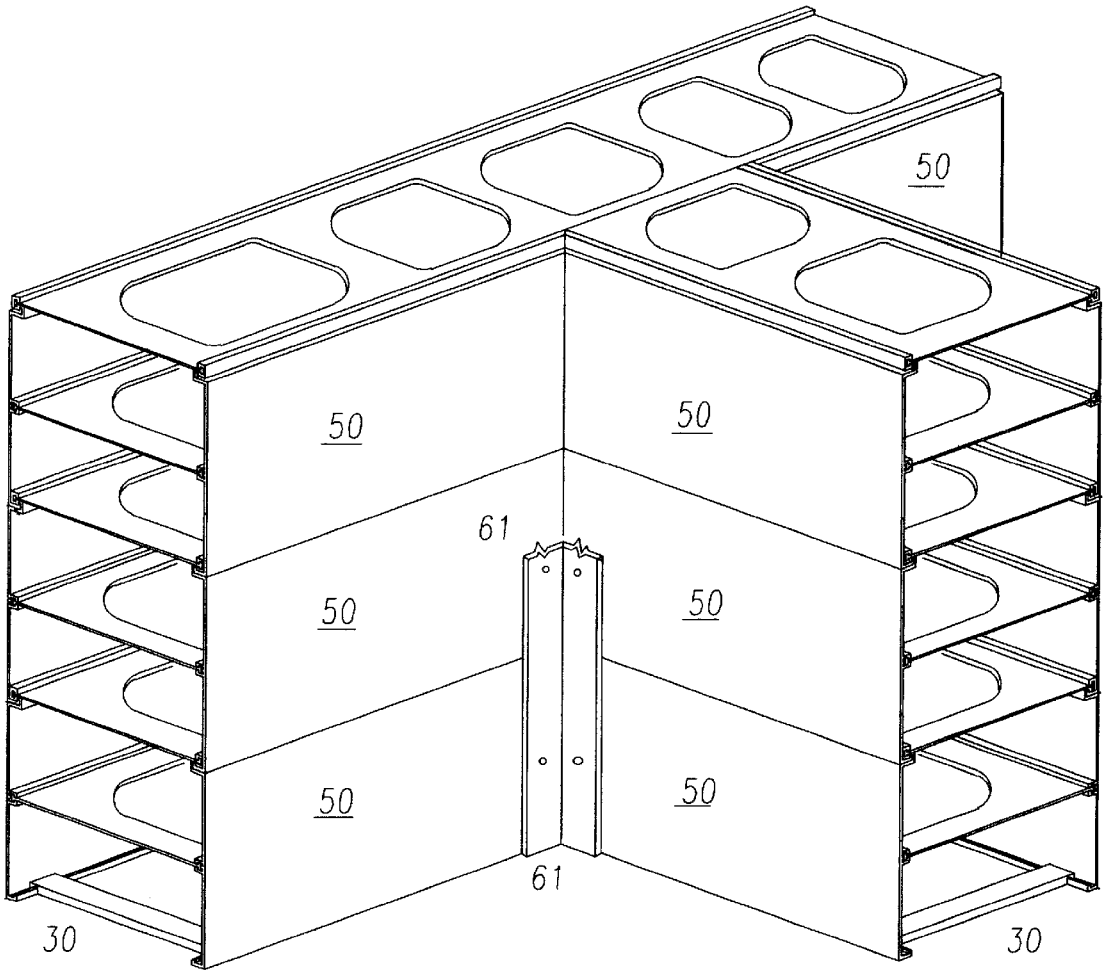
Figure 13:
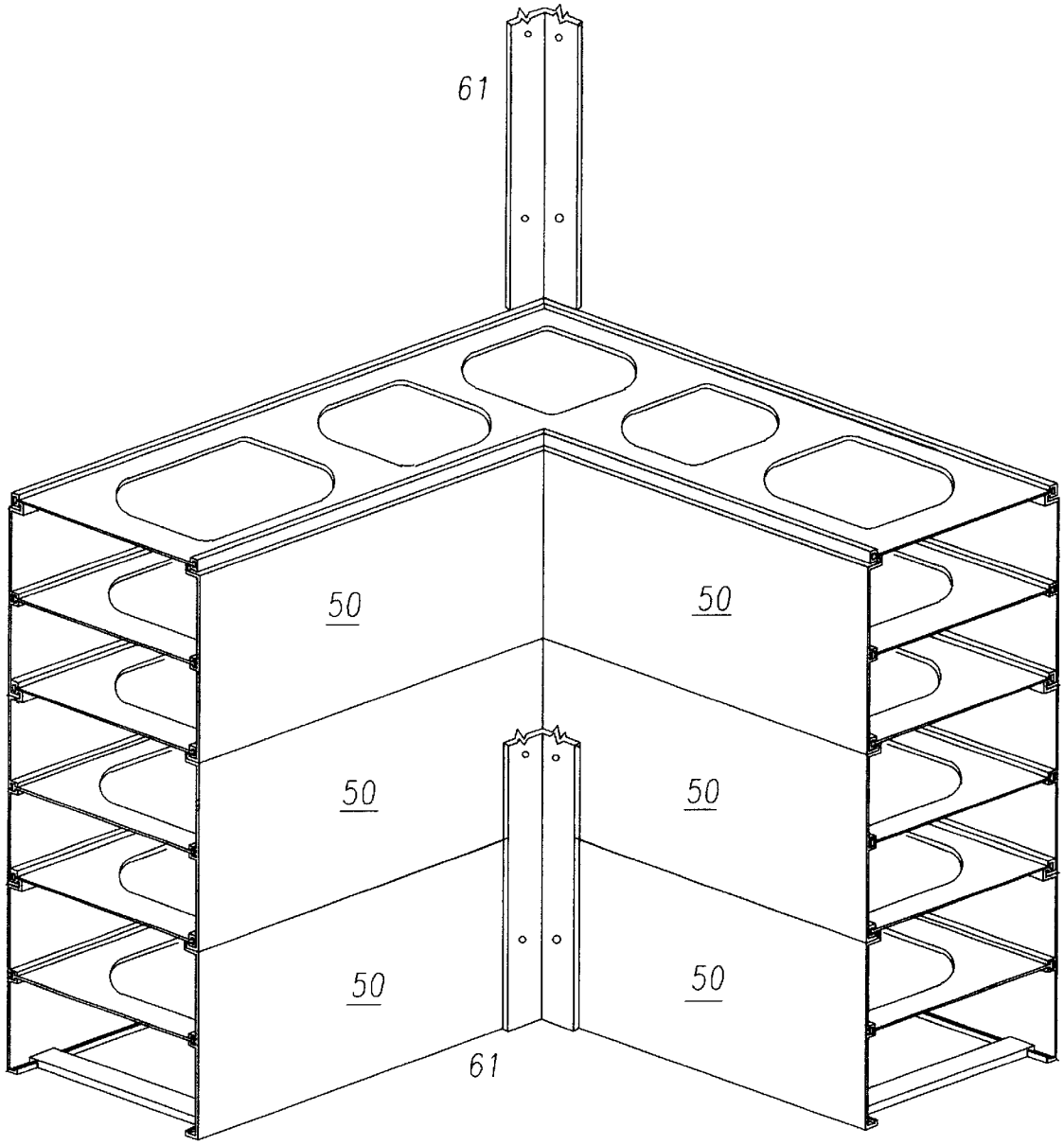

FIG. 12, is a perspective view, of a wall, intersecting another wall using stacked CPU's. 50 This view also shows the alternative method of using 2"×2" Aluminum 90% Angles, 61, screwed into the CPU's 50. This view also shows the 7⅜" Anchor, 30. The forms are shown empty, in this drawing FIG. 13, is a perspective view of an assembled section of walls, using CPU's, 50 to form a 90% comer. This view shows the reusable 2×2 Aluminum 90% Angles, 61. The forms are empty.

Figure 14:
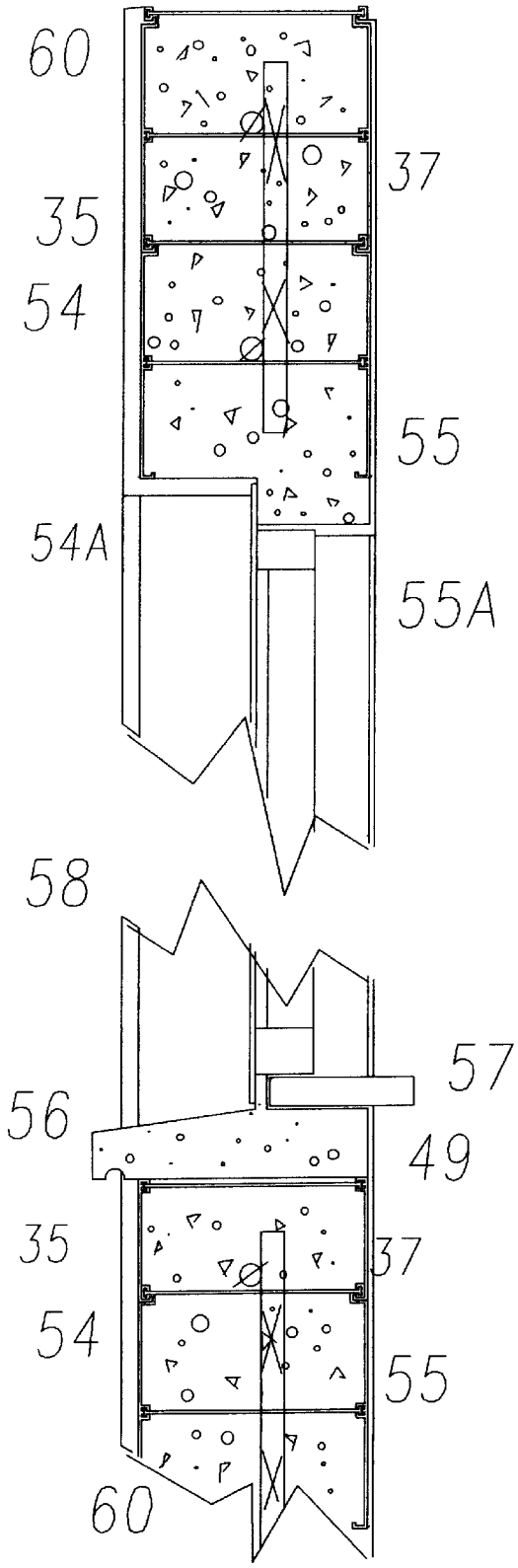

FIG. 14, is a cross section of a finished wall using CPU's, 50. It details the Poured Concrete, 60 inside the forms with the horizontal #5 Reinforcing Bars 35, and the Vertical #5 Reinforcing Bar, 37 This view details how a typical Standard Aluminum Window, 58 is installed with a pre-cast Concrete Window Sill, 56 and how the ⅞" Stucco Finish, 54, is applied, with the Thickened Stucco Finish 54A on the header and the side jambs, to cover the space needed to square up the Standard Aluminum Window, 58. It also details the Cementitious Synthetic Plaster Finish 55, used instead of furring strips and drywall, on the inside, and the use of Thickened Synthetic Plaster Finish, 55A to hide the gap at the edge of the Standard Aluminum Window, 58 on the header and the side jambs. This view details a Horizontal Cut, 49 to allow a Precast Concrete Window Sill, 56 to be installed and how the Marble Window Sill, 57 is installed.

DETAILED DESCRIPTION OF THE INVENTION

As shown in the drawings, this invention provides a clear form, for concrete, that is open on four sides. An example of this assembled clear form, is detailed in FIG. 11. The clear form, will hold wet concrete and steel in place until it has set, and is designed to stay in place, to protect the cured concrete and steel from the elements, that cause such structures to fail. The sections, are extruded in a factory, from a Clear Polyvinyl Chloride Material and are designed to be easily modified and assembled on site. The reason, for the use of a Clear PVC Material, is to be an aid in the assembly, and in the erection of a wall structure, so that the forms can be easily inspected at any stage of assembly, to make sure that all of the steel and the utilities have been installed as designed, and to be able to watch, as the forms are filled with wet concrete, to make certain that there are no voids, in the pour.

The sections can be cut to any length or angle, or modified to fit any design of a steel reinforced concrete structure, before they are assembled.

To assemble one of the forms, it only takes four sections.

Figure 1:
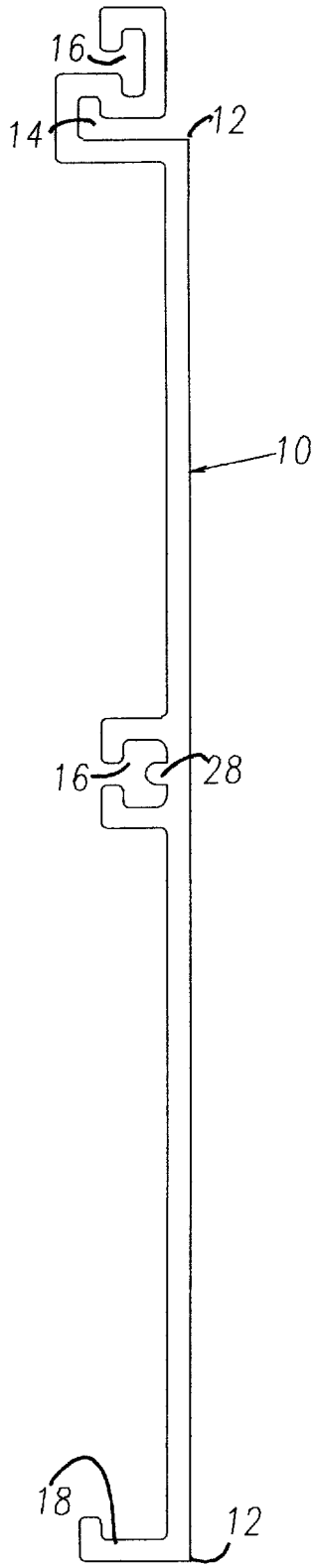
FIG. 1, is an end view, of the extrusion of Profile 1, 10. This is the face section, that forms both of the vertical side walls, of the Assembled CPU, 50. This detail shows the ⅝ inch Base 18, with the perpendicular ⅛" bend, with the Square Edge, 12. Exactly 4½ inch on center, up from the ⅝ inch base, 18, is the Continuous Reinforcing Spacer, 28, that helps form a Continuous ⅛ inch rail slot 2B, 16, that receives one of the side rails of Profile 2, 20. Exactly 8" up from the Square Edge, 12, at the ⅝ inch Base, 18, is an offset flange with another Square Edge, 12. This is the location of the Continuous ⅝ inch Rail Slot 1A, 14, this unique flange bends to form another, ⅛ inch Rail Slot 2B, 16.
Figure 2:
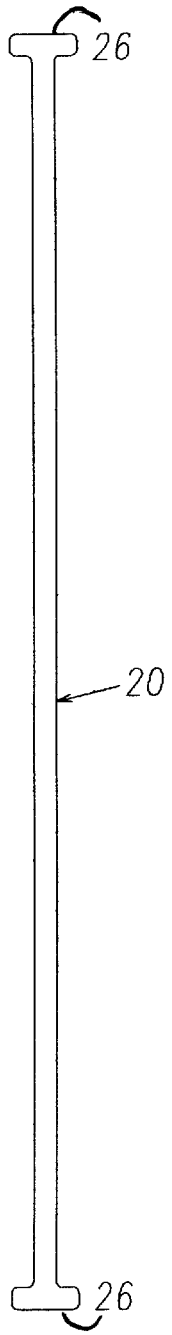
FIG. 2, is an end view, of the extrusion of Profile 2, 20. This is the center section, that forms the sections, used to space the CPU, 50 exactly 7⅝" wide. This detail also shows the end view of both, of the, Continuous Side Rails, 26.

To simplify, the instructions, for assembly, the sections will be referred to as Profile 1, 10, (see FIG. 1), and Profile 2, 20, (see FIG. 2).

The slots that receive matching rails will be referred to as, Continuous ⅝ inch Rail Slot 1A, 14 and Continuous ⅛ inch Rail Slot 2B, 16. Only a section of Profile 1, 10, will slide vertical, into a Continuous ⅝ inch Rail Slot, 1A 14. Only a section of Profile 2, 20, will slide horizontally, into a Continuous ⅛ inch Rail Slot 2B, 16 (see FIG. 4).

A top view of Profile 2, 20, showing the perpendicular, Continuous Side Rails, 26, and large 7⅛" Punched Holes, 22, is shown, in detail in FIG. 5.

It takes two sections of Profile 1, 10, cut to any length, and two sections of Profile 2, 20, also cut to any length, to assemble a Concrete Plastic Unit, 50.

FIG. 11, details an assembled CPU, 50. As can be seen in this detail Profile 1, 10 forms both vertical sides, of the hollow unit. Profile 2, 20 can be seen, installed horizontally in two locations inside of the hollow form, at the top, and in the middle.

The 7⅜" Anchor 30 is shown, locked in over the ⅝ inch Base, 18, on the bottom inside of two sections of Profile 1, 10 this is accomplished by the use of the Insert/Spreader Lock, 29, a ⅛ notch that fits over the ⅛ perpendicular bend on the end of the ⅝ inch Base 18. This 7⅜" Anchor, 30 serves two purposes.

One, it spreads the two side sections of the Concrete Plastic Unit, 50 exactly 7⅝" wide. The same width of a Concrete Masonry Unit.

Two, it provides a means to secure the first course to the concrete slab, to hold the unit in place and spread the required distance apart by using the Insert/Spreader Lock, 29, while the other units are assembled in horizontal courses on top, of each other and stacked as high as the plans show The unique configuration of Profile 1, 10, allows this one continuous extrusion, to be used on both vertical sides of the form. The face side of Profile 1, 10 is smooth, and is exactly 8 inches high from the Square Edge, 12, at the ⅝" Base, 18, to the Square Edge, 12, at the offset flange. This is the exact height of a Concrete Masonry Unit, setting in a ⅜ inch bed of mortar, 8 inches high.

The way a section of Profile 1, 10 is configured, allows two sections of Profile 1, 10 to be connected in a bottom to top relationship, by sliding the Continuous ⅝ inch Base, 18, of one section, of Profile 1, 10, into the Continuous ⅝ inch Rail Slot 1A, 14, at the Square Edge 12, in the offset flange, in the top of another section of Profile 1, 10.

When the two Square Edges, 12, are joined together, this connection makes a continuous Smooth Seam or Joint, 13.

The configuration of the continuous ⅝ inch Base, 18, not only allows it to slide into the continuous ⅝ inch Rail Slot 1A, 14, it also allows the Assembled Concrete Plastic Unit to be attached to a concrete slab without using the 7⅜" Anchor, 30 by drilling a hole through the flat bottom of the ⅝" Base, 18 and attach the Assembled CPU, 50 to the slab with a Tapcon Screw.

Referring now to FIG. 4A, as one can see, when the two sections are connected they form an almost invisible Smooth Seam or Joint, 13, on the exterior face, of the form. This is accomplished because of the Square Edges, 12, located at the offset flange, and at the ⅝ inch Base, 18. This connection is shown in a close up, in Detail C, on drawing FIG. 21. Still another feature of Profile 1, 10, is the continuous ⅛" Rail Slot 2B, 16. This slot is located in two places, on the inside of a section, of Profile 1, 10, and is designed to receive the perpendicular, Continuous Side Rails, 26, of Profile 2, 20.

One location is exactly 4½ inches up from the ⅝ inch Base, 18. This slot, has a Continuous Reinforcing Spacer, 28, that not only gives the clear form, the additional strength in the side walls, the Reinforcing Spacer, 28, also makes it possible for the Continuous Side Rails, 26, of Profile 2, 20, to be inserted into the form horizontally, at both locations, to provide the clear form, with the exact width. This connection is shown in a close up drawing, in Detail B, on drawing FIG. 4C.

This close up Detail B, shows one perpendicular, Continuous Side Rail, 26, of a horizontal section, of Profile 2, 20, inserted into the matching, Continuous ⅛" Rail Slot 2B, 16. It also details how the Continuous Reinforcing Spacer, 28, is used to strengthen the side walls by doubling the thickness of the clear form when this connection is made. The other matching, Continuous ⅛" Rail Slot 2B, 16, is located just above the Continuous ⅝ inch Rail Slot 1A, 14, on the inside, in the offset flange. This is shown in the close up drawing in Detail A, in the drawing FIG. 4C. This drawing shows both slots empty.

The unique configuration of the offset flange allows the connection of three sections, two section of Profile 1, 10, and one section of Profile 2, 20, each having a thickness of ⅛ inch, but when connected together, into their receiving slots, the sections form a continuous strengthening, Smooth Seam or Joint, 13, that is ¾ inch thick, of solid clear PVC plastic at this point.

This band of solid clear plastic on both sides of the clear concrete form, not only gives the form the continuous lateral, tensile strength needed to hold the wet concrete in place until it has set, but also provides for a water tight joint. This water tight joint helps to protect the concrete after it has cured. This connection is shown in a close up drawing in Detail C, in drawing FIG. 4C. Profile 2, 20, is also a continuous extrusion made from Clear Polyvinyl Chloride. The extrusion is installed horizontally, in matching Continuous ⅛ inch Rail Slots, 2B, 16 between two sections of Profile 1, 10 Profile 2, 20, is exactly 7 1/8 inches wide, and has large 7⅛" Punched Holes, 22, punched into the extrusion in a pattern with a 1 inch space between the 7⅛" Punched Holes, 22. There are two perpendicular, Continuous Side Rails, 26, on each side of the extrusion. A top view of Profile 2, 20, is shown in FIG. 5.

Two sections of Profile, 2 20, is used both as a spreader and as a retainer, between two sections of Profile 1, 10. This detail is shown in FIG. 4. FIG. 4 also shows the 7⅜" Anchor, 30.

Figure 3:
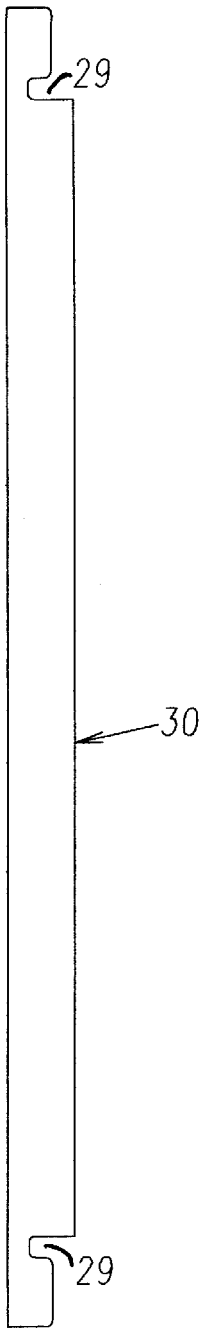
FIG. 3, is an end view of the vacuum formed CPU 7⅜" Anchor, 30. This view shows the Insert/Spreader Lock, 29, on both ends of the 7⅜" Anchor, 30. The 7⅜" Anchor, 30, is used to attach the first course of the assembled CPU's 50 to the Concrete Slab, 34, with the use of two Tapcon Screws 38.

The 7⅜" Anchor, 30, as shown in FIG. 3, is vacuumed formed, from a clear Polyvinyl chloride material. The 7⅜" Anchor, 30, is 1 inch wide and ⅜ inches thick. On each end, it has a ⅛ slot, that fits over the base of Profile 1, 10, this ⅛" slot provides an Insert/Spreader Lock, 29, that keeps the forms from spreading apart. The 7⅜" Anchor, 30, is attached to the concrete slab, 34, with two Tapcon Screws, 38. This 7⅜" Anchor 30, is not needed to complete a structure, but is provided to make it easier to install the first course.

The 7⅜" Anchor, 30, stays in place, and holds the first course in place, until the whole structure is erected and completed.

Referring now to FIG. 4B, this detail shows an exploded view, of a Concrete Plastic Unit, 50, that shows how the four sections, of the two different Profiles, attach together. This detail shows how the Profile 2, 20, Continuous Side Rails, 26, are inserted into, and slid down, the Continuous ⅛ inch Rail Slots 2B, 16, at two different locations on the inside of two Sections of Profile 1, 10 to spread the two sections of Profile 1, 10. And to give the clear form the lateral tensile strength, needed to contain the wet concrete until it has set.

This detail also shows how the 7⅜" Anchor, 30, is used as an Insert/Spreader Lock, 29, that fits over the ⅝ inch Base, 18, and locks over the ⅛" perpendicular bend, of a section of Profile 1, 10. This detail also shows how the large 7⅛" Punched Holes, 22, are aligned over one another, so that vertical steel can be installed. These large 7⅛" Punched Holes, 22, also allow the wet concrete to flow freely throughout the structure.

These 7⅛" Punched Holes, 22, are also large enough to stick your hand through, to install the 7⅜" Anchor, 30 and to drill the holes through the plastic into Concrete Slab, 34 and attach the Assembled Concrete Plastic Unit, 50 to the concrete slab using two Tapcon Concrete Screws 38.

Referring back to FIG. 4A, detailing how two Assembled Concrete Plastic Units, 50, stacked on top of one another. When the Assembled CPU's, 50 are slid together and stacked, as shown in FIG. 9, they can be configured into any size or shape of any planned structural design approved by the Local Building Departments.

Referring back to FIG. 9, this detail shows a Monolithic Concrete Footer and Slab, 34. This detail shows the location of three Horizontal #5 Reinforcing Bars, 35, with Up Turn #5 Reinforcing Bar, 36, imbedded in cured concrete extending up through the slab, 34, There is another Vertical #5 Reinforcing Bar, 37, over lapping the upturn #5 Reinforcing Bar, 36. This detail also shows how the Assembled CPU's, 50, are slid together and stacked on top of one another and how the 7⅜" Anchor, 30, is secured to the Monolithic Concrete Footer and Slab, 34, with two, Tapcon Concrete Screws, 38, to hold the first course in place until the wet concrete is poured into the clear forms.

As mentioned before the sections can be modified on site and cut on any angle or combination of angles to meet any design. The most common combination angle is the 90 degree angle used on 90 degree corners. This corner can be formed by making two opposite vertical 45% angle cuts in two separate sections of Profile 1, 10. (This is the same method used by those skilled in the Art of Carpentry when installing horizontal siding) two sections of Profile 2, 20 is also cut, using two opposite horizontal 45% cuts to form a 90% angle. (These cuts, use the same method that are used to make a 90% comer of a picture frame). When all of the sections, are assembled with opposite angles facing each other, this 90% comer is glued together, with a clear PVC cement. To connect the ends and to close off the ends to make the joint water tight. This detail is shown in FIG. 10.

Once a course of Assembled Concrete Plastic Units, 50 are installed horizontally around the perimeter of a structure, Horizontal #5 Reinforcing Bars, 35, can be installed in any course and the reinforcing bars can be bent, around the comer to lap, 35A, another piece of horizontal #5 Reinforcing Bars 35, to create a continuous reinforcement bar, around the perimeter of a structure as required by most Building Department Codes. This is detailed in FIG. 10 mentioned above.

Referring back to FIG. 10 this detail also shows how the Vertical #5 Reinforcing Bars, 37 are installed. The transparency of the forms are bot shown in this detail.

The Assembled Concrete Plastic Units, 50, are stacked as described, one course at a time around the perimeter of the structure until the whole structure is completed according to plans. At this stage, the bracing is installed. This is standard bracing for reinforced concrete structures, to align the clear forms and hold them in place until the concrete is poured and the concrete has cured.

Up to this point the whole assembly could have been inspected at any time to make certain all of the reinforcing bars and the utilities were in place, because a clear material had been used to extrude the profiles that make up the forms.

When the formed structure is filled with Poured Concrete, 60, as shown in FIG. 14 any problems with voids in the pouring of the concrete, would have been detected and corrected before the pour was finished.

This is solving a problem, that none of the Prior Arts could have solved.

Therefore it should be obvious, that a building built with Concrete Plastic Units, 50, creates a better stronger structure, that is essentially indestructible. A structure that will withstand most natural phenomenons.

What is claimed is:

1. A factory extruded permanent clear form for steel reinforce concrete structures that is made from polyvinyl chloride material to facilitate inspection of said clear form, said clear form consisting of;

(a) only two factory extruded profiles that are totally different in shape, wherein only two sections of a first profile provide for two vertical side sections and only two sections of a second profile are inserted horizontally between the vertical side sections of the first profiles and wherein;

(a1) said first profile has an exposed smooth face that includes a means for providing lateral tensile strength to said clear form, said means for providing lateral tensile strength consisting of a continuous ⅛ inch offset connecting flange at a top of the clear form and a perpendicular ⅝ inch base that protrudes horizontally towards an inside of the first profile, an inside face of the first profile has two ⅛ inch slots that also protrude toward an inside of the first profile, (a2) said second profile has large holes punched therein that provides a means for installing, bending, and lapping of horizontal steel reinforcing bars to create a continuous horizontal reinforcing bar and includes perpendicular side rails on each side to facilitate installation into the ⅛ inch slots of said first profile, thereby spreading said clear form to allow for the introduction of vertical steel utilities and free flow of concrete therein, and;

(b) a means for providing additional strength to a middle portion of the clear form including a continuous reinforcing spacer disposed 4 inches up from the perpendicular ⅝ inch base of the first profile;

(c) a means to stack said clear form in horizontal courses such that the clear forms are adapted to be arranged in any planned configuration with only flush joints or seams;

(d) a means to secure the horizontal courses of said clear forms to a concrete slab or footer including a clear vacuumed formed ⅜ inch anchor having a locking device that slides over the perpendicular ⅝ inch base in an adjacent horizontal course and locks the clear forms in place to keep the clear form from spreading until the clear form is secured to the slab with tapcon screws;

(e) a means to close up ends of the clear form to keep wet concrete from spilling out and provide for a watertight connection; wherein said clear form is adapted to bond with the cured concrete to become an integral part of the steel reinforced structure.

* * * * *